United States Patent [19]

Cripe

[11] 4,289,249

[45] Sep. 15, 1981

[54] CONTAINER

[76] Inventor: Herman S. Cripe, 2030 Hillsdale, Kalamazoo, Mich. 49007

[21] Appl. No.: 651,932

[22] Filed: Jan. 23, 1976

Related U.S. Application Data

[63] Continuation of Ser. No. 395,289, Sep. 7, 1973, abandoned, which is a continuation-in-part of Ser. No. 175,479, Aug. 27. 1971, abandoned.

[51] Int. Cl.[2] ..... B65D 85/00; B65D 43/00

[52] U.S. Cl. ..... 220/22; 229/42

[58] Field of Search ..... 220/20, 22; 206/249, 206/253, 254, 256, 443; 229/42

[56] References Cited

U.S. PATENT DOCUMENTS

| | | | |
|---|---|---|---|
| 1,046,263 | 12/1912 | Calkins | 220/324 |
| 1,922,571 | 8/1933 | Deline | 229/42 |
| 2,685,366 | 8/1954 | Jenner | 229/42 |
| 2,978,285 | 4/1961 | Jester | 220/22 X |
| 3,052,368 | 9/1962 | Atkins et al. | 220/22 |

*Primary Examiner*—Steven M. Pollard

*Attorney, Agent, or Firm*—Gordon W. Hueschen

[57] ABSTRACT

A container for pencils or similar elongated articles comprising a hollow base portion, a shell cover means for the hollow base portion and a plurality of radially extending partitions allowing maintenance of separation, ready storage, and convenient flaring upon removal of the cover. The ratio of the height of the lateral wall to the radius of the base portion is such as to prevent pencils from falling out of the container while allowing the pencils to flare from the vertical upon removal of the cover.

2 Claims, 6 Drawing Figures

CONTAINER

CROSS REFERENCE

This application is a continuation of application Ser. No. 395,289, filed Sept. 7, 1973, now abandoned, which in turn is a continuation-in-part of application Ser. No. 175,479, filed Aug. 27, 1971, also abandoned.

BACKGROUND OF THE INVENTION

This invention relates to containers adapted to contain pencils or similar elongated articles. In one particular aspect this invention relates to containers for artists' sets of color pencils.

Presently, artists' sets of color pencils are available in ordinary boxes with pencils of different hues in the color spectrum packed in a plurality of layers. Such an arrangement often makes the removal of a particular desired pencil difficult, militates against an orderly replacement of pencils in the set after use, and precludes the artist from readily ascertaining whether or not the supply of pencils in a particular hue or chroma is depleted and is in need of restoration, especially if the short, used pencils are hidden from view.

It is an object of the present invention to obviate the aforesaid difficulties and to provide a new type of container for pencils where immediate access to each and every pencil in the container is available. A further object of this invention is to provide a container where pencils can be readily replaced after use in an orderly manner. An additional object of this invention is to provide a container the inventory of which can be quickly surveyed. Still other objects will readily present themselves to one skilled in the art upon reference to the ensuing specification, the drawings, and the claims.

SUMMARY OF THE INVENTION

The present invention contemplates a container comprising a hollow base portion; a plurality of radially extending partitions within the base portion; and a shell cover means for the base portion. The partitions divide the hollow base portion into a plurality of compartments which are adapted to receive therein one end of a plurality of pencils or the like. The partitions also project above the base. The cover means slides over the projecting portions of the partitions and frictionally engages outer edges of the projecting portions. The height of the lateral wall of the base portion relative to the radius of the base portion of the container is such as to prevent pencils in the container from falling out of the container while at the same time being of such size as to permit but limit outward flaring of pencils in said container down to an angle of about 45 degrees from the vertical for ready selection by the user when the cover means is removed.

Although occupying a relatively small space on the desk, table or taboret, this invention, by separating and restraining the lower part of the pencils or similar elongated objects within its various compartments, while at the same time allowing for the upper and greater portion of said objects to flare out, provides for ready accessibility and quick color determination and selection.

DESCRIPTION OF THE PREFERRED EMBODIMENTS

Figure 1:
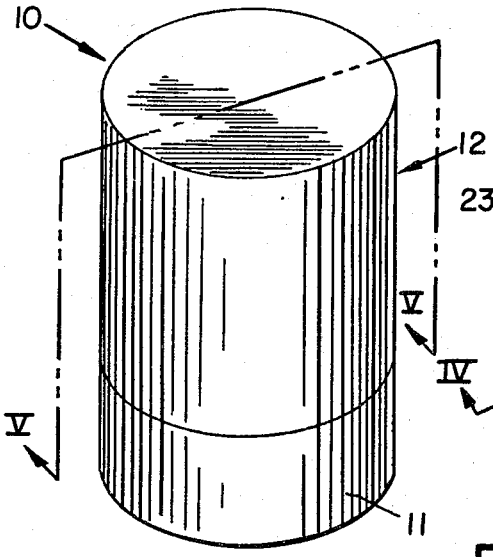
FIG. 1 is a perspective view of the container of this invention.
Figure 2:
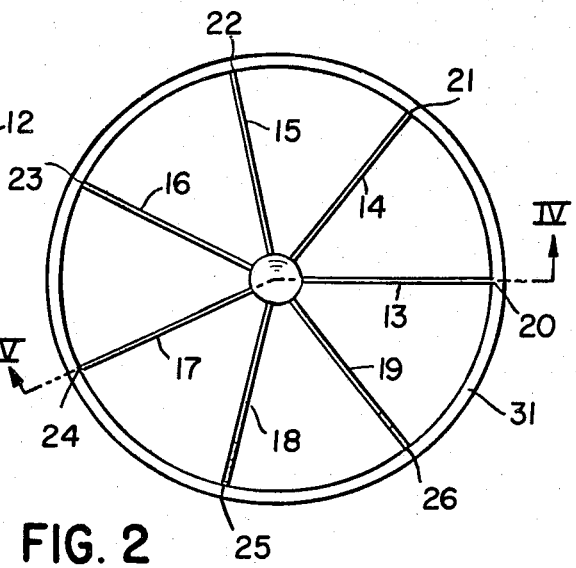
FIG. 2 is a top plan view of the container with the cover means removed.

Referring to FIG. 1, upright cylindrical pencil container 10 comprises hollow cylindrical base portion 11 and cylindrical shell cover means 12 therefor. As shown in FIG. 2, partitions 13, 14, 15, 16, 17, 18 and 19 extend radially from the center of base portion 11 and define seven separate compartments which can receive one end of plurality of pencils. Any desired number of compartments can be provided; however, for color pencils seven compartments are used in the illustrated embodiment since this arrangement lends itself to an efficient grouping of the pencils.

Figure 3:
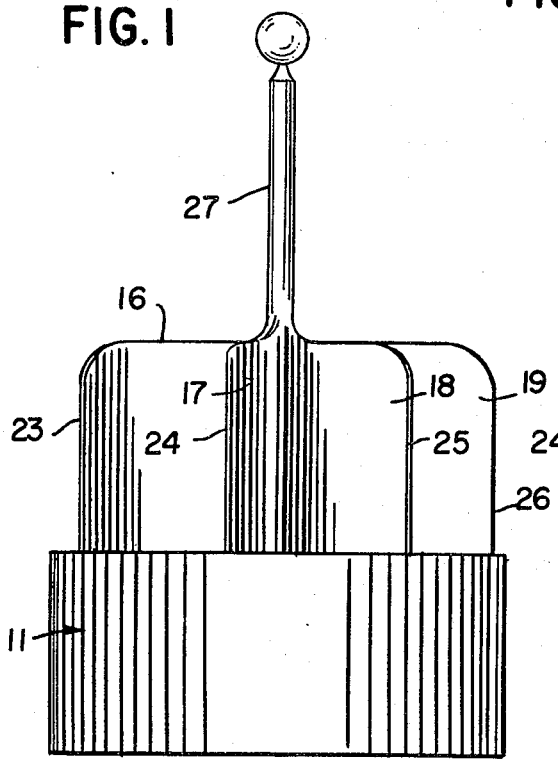
FIG. 3 is a side elevational view of the container with the cover means removed.
Figure 4:
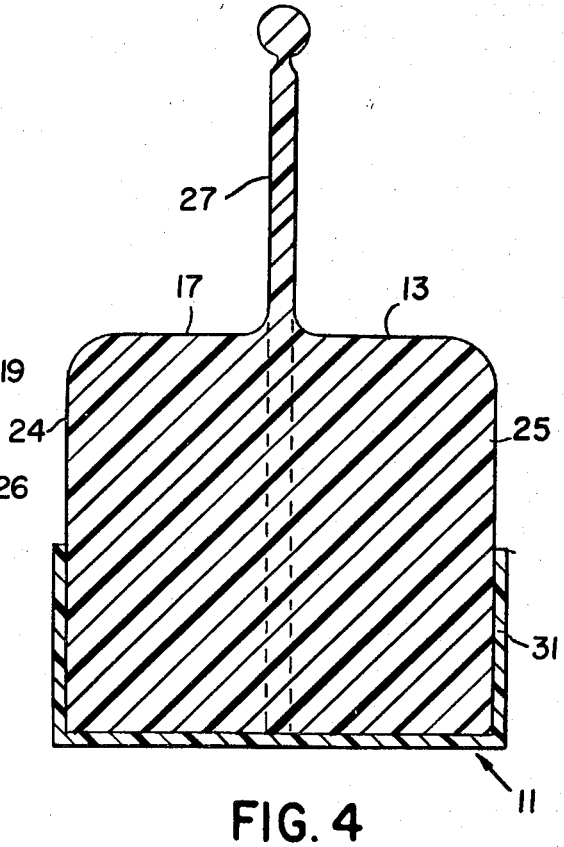
FIG. 4 is a sectional elevation of the container taken along line IV—IV in FIG. 2.

The radially extending partitions such as partitions 16, 17, 18 and 19 (FIG. 3), project upwardly above hollow base portion 11. Outer edges 20, 21, 22, 23, 24, 25 and 26 of respective partitions 13, 14, 15, 16, 17, 18 and 19 are adapted to frictionally engage the inner lateral surface of cylindrical shell cover means 12 and to hold cover means 12 in place when container 10 is closed. While at least three outer edges, spaced about 120 degrees apart, should frictionally engage cover means 12 for holding, preferably all outer edges of the partitions present are adapted to frictionally engage the inner lateral surface of cover means 12.

Optional upright central post 27 (FIGS. 3, 4, and 5 and 6) can be fixedly secured to base portion 11 or to the partitions so as to provide a grip means which facilitates the handling of base portion 11 filled with pencils when cover means 12 is removed. Moreover, central post 27 can be turned between the fingers of a person using the pencils situated in the several compartments so as to bring the desired compartment into convenient proximity to the user. Preferably central post 27 is secured directly to base portion 11.

Figure 5:
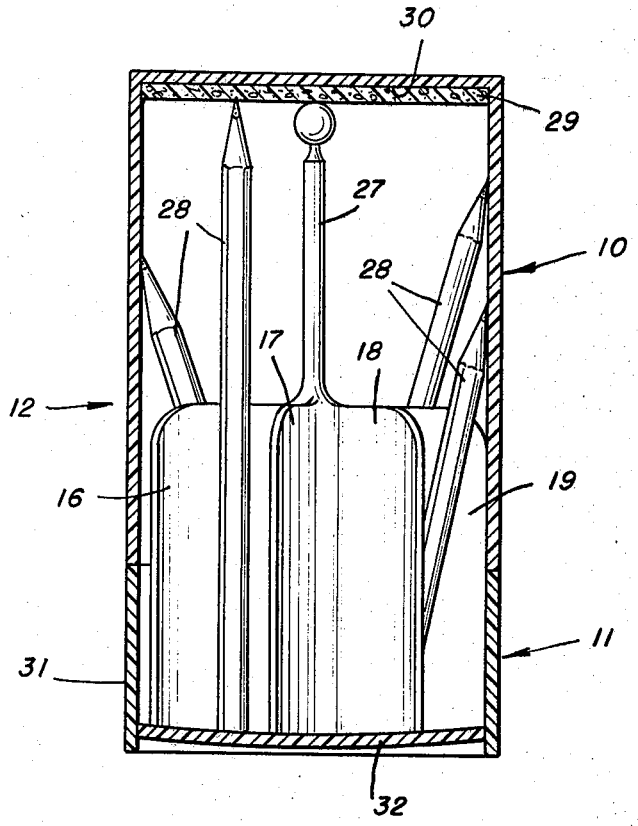
FIG. 5 is a sectional elevation of the container shown in FIG. 1 taken along line V—V.

As shown in FIG. 5, pencils such as pencil 28 (four shown) are normally situated within container 10 in a substantially upright position when cover means is in use, one end of the pencil within a compartment defined by the partitions such as partition 16 and 17, and the other end near inner upper surface 30 of cylindrical shell cover means 12. If desired, resilient pad 29 can be provided to line inner upper surface 30, and the upper end of a pencil such as pencil 28 can be made to abut against resilient pad 29 by an appropriate choice of depth for cover means 12 so as to retain pencil 28 or the like firmly within container 10 during shipment. The shell cover means for the base portion slides over the projections and frictionally engages at least some, e.g., at least three, of the projecting portions of the partitions. The cover means has a lateral wall adapted to coincide with and contact the lateral wall of the base portion about the entire periphery of the container. When the cover means 12 is in position for closing the container, the height of the lateral walls of the cover 12 together with the height of the lateral wall 31 of the base portion 11 being sufficient to permit pencils to be retained in a substantially upright position within the container when the container is closed, the height of the lateral wall of the cover means being substantially greater than the height of the lateral wall 31 of the base portion.

Depth of the several compartments in base portion 11 is determined by the height of lateral wall 31 thereof, and is selected so as to allow pencils within the compartments to flare outwardly as cover means 12 is removed while at the same time retaining the lower ends of the pencils within the compartment. A compartment depth of about 1½ to 2 inches is sufficient for this purpose for a standard 7.5 inch pencil. Also, bottom 32 of base portion 11 can be made concave to a slight degree as shown in FIG. 5 so as to enhance the tendency of the pencils to flare outwardly when cover means 12 is removed.

Figure 6:
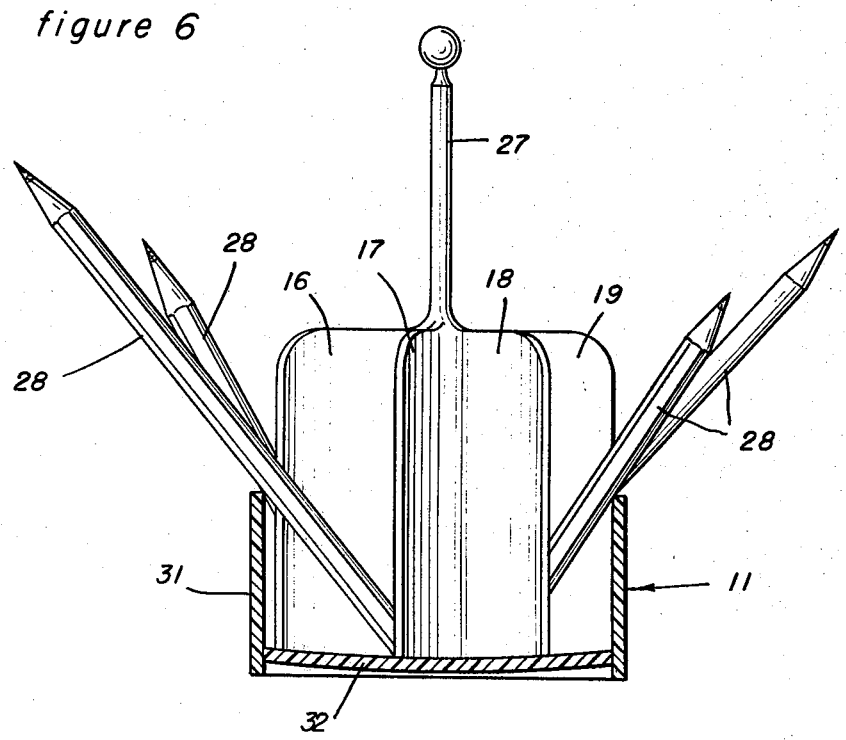
FIG. 6 is a sectional elevator of the container shown in FIG. 1, with the cover means removed, showing pencils therein in a flared position.

As shown in FIG. 6, the height of the lateral wall 31 of the base portion 11 relative to the radius of the base portion is such as to limit outward flaring of pencils in said container to about 45 degrees from the vertical for ready selection by the user when the shell cover means is removed, while at the same time being of such height as to prevent pencils in the container from falling out. That is, the container of this invention retains full size pencils by their lower portions while permitting the larger upper portions of the pencils to be exposed and readily accessible to the user, while the container occupies little desk area. Preferably, the ratio of the height of the lateral wall of the base portion relative to the radius of the base portion is such as to allow pencils in the container to flare down to as much as 45 degrees from the vertical when the cover means is removed. For example, in a container designed to loosely hold about 60 to 72 pencils, varying in colors, hardnesses, or other types, approximately evenly divided in number in a seven compartment container, as shown, the ratio of the height of the lateral wall of the base portion to the radius of the base portion of the container is preferably about 1:1, expressed in the same measurement units.

This invention also includes the sub-combination of the base portion of the container, described as above. However, it is believed that the shell cover means adds a useful purpose and function to this container combination. With the container combination, including the shell cover means, this invention permits the ready storage of a large number of pencils, already divided into desired color or type combinations, in a substantially upright position, secured against pencil point breakage, spillage or loss, and dust-free, in a single attractive, functional container, of relatively small unit volume, while retaining ready accessibility to the pencils when their need is desired by removal of the cover.

The container also, with or without the cover, allows pencils, swizzle sticks, and the like to be kept appropriately separated on a crowded table, desk, bar, work bench, or the like, while permitting the pencils or sticks to flare in the container, above the table, desk, bar, or bench level when the cover is removed. The user can quickly pick through a group of up to 10 to 12 flared pencils or other sticks or rods of one part of the color spectrum in one compartment for the exact color or type desired, thus eliminating the necessity of picking through as many as 100 pencils comprising the entire color spectrum each time a different pencil is needed.

This invention, in addition to providing a means of organizing and separating pencils into their various spectra, could be utilized to separate various types of writing implements and the like, e.g., graphite pencils, charcoal pencils, china markers, felt marking devices, and the like.

After use, pencils can be manually gathered toward the center of container 10. Cover means 12 is then slipped thereover, sliding over the partition portions that project above hollow base portion 11 and frictionally engaging the outer edges of these portions.

The foregoing discussion and the drawings are illustrative but are not to be taken as limiting. Still other variations and rearrangements of parts and uses of the container within the spirit and scope of the present invention are possible and will present themselves to one skilled in the art.

What is claimed is:

1. An upright cylindrical container for pencils which comprises a base portion having a bottom and an outside wall defining one half of a hollow cylinder and a cover portion having a top and an outside wall defining the other half of the hollow cylinder, said base and cover portion having the same inside diameter;

a plurality of radially extending partitions mounted within the base portion, dividing the base portion into a plurality of compartments adapted to receive therein one end of a plurality of pencils, said compartments being so proportioned to the pencils that the other ends thereof project above the outside wall of the base portion, at least three of said partitions projecting above the outside wall of the base portion and extending outwardly all the way to the inner circumference of said cylinder so that the outer edges thereof frictionally engage said cover portion at at least three separate points about the inner circumference thereof;

the depth of the several compartments of the base portion being determined by the height of the outside wall and said depth being selected to allow the pencils to flare outwardly while at the same time retaining the pencils within the compartment;

the height of the outside wall of the base portion relative to the radius of the base portion being such as to limit outward flaring of pencils in said container to about 45 degrees from the vertical for ready selection by the user;

the height of said cylinder being sufficient to retain pencils in an upright position within said container when said container is closed, and the height of the outside wall of said cover portion being substantially greater than the height of the outside wall of the base portion, and wherein the bottom of the hollow base portion is concave so that the compartments are deeper near the center than they are near the outside wall.

2. An upright, cylindrical container with a plurality of pencils therein forming a package, which comprises a base portion having a bottom, and an outside wall defining a hollow cylinder; a plurality of radially extended partitions mounted within the base portion, dividing it into a plurality of compartments holding therein one end of the pencils, the dimensions of the compartments being such that the pencils project above the hollow base portion, the depth of the several compartments of the base portion being determined by the height of the outside wall; the height of the outside wall of the base portion relative to the radius of the base portion being such as to limit outward flaring of pencils in said container to about 45 degrees from the vertical, while at the same time being of such height as to prevent pencils in the container from falling out, and removable confining means for retaining the pencils in a substantially upright position during storage, the number of pencils being such that they do not fill the compartments to the extent that would prevent them from flaring outwardly upon the removal of said confining means whereby, upon removal of said confining means, the pencils flare outwardly to a position from which individual pencils can be readily selected by the user, in which the removable confining means is a removable cover having a resilient pad therein, said cover being spaced from the bottom slightly more than the length of a pencil and the resilient pad having a thickness such that it is spaced from the bottom slightly less than the length of a pencil, whereby when the pencil stands vertically in one of the compartments with its point up, the point will abut against the resilient pad, and in which the bottom of the hollow base portion is concave so that the compartments are deeper near the center than they are near the outside wall but not so concave that the vertical height from the center portion of a compartment to the resilient pad is greater than the length of a pencil.

* * * * *